US008480201B2

(12) United States Patent
Tokushima

(10) Patent No.: US 8,480,201 B2
(45) Date of Patent: Jul. 9, 2013

(54) RECORDING DEVICE

(75) Inventor: Daiki Tokushima, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 91 days.

(21) Appl. No.: 13/177,751

(22) Filed: Jul. 7, 2011

(65) Prior Publication Data

US 2012/0019580 A1 Jan. 26, 2012

(30) Foreign Application Priority Data

Jul. 21, 2010 (JP) ..... 2010-163802

(51) Int. Cl.
*B41J 29/38* (2006.01)

(52) U.S. Cl.
USPC ..... 347/14

(58) Field of Classification Search
None
See application file for complete search history.

(56) References Cited

U.S. PATENT DOCUMENTS 5,541,626 A * 7/1996 Hiramatsu et al. ..... 347/8
5,953,104 A * 9/1999 Matsumoto ..... 355/40
2007/0274754 A1 11/2007 Tanaka et al.

FOREIGN PATENT DOCUMENTS

JP 2007-313663 A 12/2007

* cited by examiner

*Primary Examiner* — Stephen Meier
*Assistant Examiner* — Tracey McMillion
(74) *Attorney, Agent, or Firm* — Global IP Counselors, LLP

(57) ABSTRACT

A recording device has a medium-supporting part that supports a long recording medium, a recording processing part that performs recording process on the recording medium supported by the medium-supporting part, a recording processing part conveyance system that moves the recording processing part, a medium conveyance system that includes a first drive roller, a first drive motor, a second drive roller and a second drive motor, and a control unit that controls the recording device. The control unit retracts the recording processing part to an area outside of the medium-supporting part while maintaining the movement direction of the recording processing part at a time at which an abnormality has occurred in an interval in which the recording processing is carried out on the recording medium while the recording processing part scans above the recording medium by the recording processing part conveyance system.

5 Claims, 10 Drawing Sheets

RECORDING DEVICE

CROSS-REFERENCE TO RELATED APPLICATIONS

This application claims priority to Japanese Patent Application No. 2010-163802 filed on Jul. 21, 2010. The entire disclosure of Japanese Patent Application No. 2010-163802 is hereby incorporated herein by reference.

BACKGROUND

1. Technical Field

The present invention relates to a recording device.

2. Related Art

Inkjet printers are widely known as recording devices, and a printer that can record on long continuous paper is described in, e.g., Japanese Laid-Open Patent Application No. 2007-313663. In the printer disclosed in this publication, a configuration is provided in which tension is applied to continuous paper on a platen by providing a difference in rotational speed between a conveyance roller unit for feeding out continuous paper onto the platen and a conveyance roller unit for conveying the continuous paper out from the platen.

SUMMARY

When an abnormality occurs in the conveyance system, a recording medium undergoes an excessive load or the recording medium flexes and interferes with the device in the case that a long recording medium such as continuous paper is used. In the particular case that the recording medium flexes on a platen, the recording medium may come into contact with the inkjet head and cause a defect in the inkjet head or the head conveyance system.

The method for handling an abnormality in the conveyance system is generally to stop operation of the device immediately when the abnormality is detected. However, this method has a drawback in that the product in process is wasted.

The present invention was contrived in view of the foregoing problems of the prior art, and an object thereof is to provide a recording device that can reduce interference with the recording processing part in the case that an abnormality has occurred in the conveyance system of the recording medium.

A recording device according to one aspect of the present invention includes a medium-supporting part, a recording processing part, a recording processing part conveyance system, a medium conveyance system and a control unit. The medium-supporting part is configured and arranged to support a long recording medium. The recording processing part is configured and arranged to perform recording process for recording on the recording medium supported on the medium-supporting part. The recording processing part conveyance system is configured and arranged to move the recording processing part parallel to a support surface of the medium-supporting part. The medium conveyance system includes a first drive roller configured and arranged to feed the recording medium to the medium-supporting part, a first drive motor connected to the first drive roller, a second drive roller configured and arranged to convey the recording medium out from the medium-supporting part, and a second drive motor connected to the second drive roller. The control unit is configured to control the recording device such that, when a predetermined abnormality has occurred in the medium conveyance system in an interval in which the recording processing is carried out on the recording medium while the recording processing part scans above the recording medium by the recording processing part conveyance system, the control unit is configured to carry out an operation to retract the recording processing part to an area outside of the medium-supporting part while maintaining a movement direction of the recording processing part at a time at which the abnormality has occurred, or carry out an operation to retract the recording processing part to an area outside of the medium-supporting part so as to move in a direction toward a closer one of edges of the medium-supporting part at a time at which the abnormality has occurred, regardless of the movement direction of the recording processing part at the time at which the abnormality has occurred.

In accordance with the aspect described above, since the recording processing part is retracted to an area outside of the medium-supporting part in the case that a predetermined abnormality has occurred in the medium conveyance system, contact between the recording processing part and the recording medium can be made less liable to occur even when the recording medium flexes due to an abnormality. It is thereby possible to prevent defects from extending to the recording processing part due to an abnormality of the medium conveyance system. Since the retract operation is carried out by moving the recording processing part in the unchanged forward direction of movement in the recording process when the recording processing part is to be retracted, the recording processing part can be rapidly retracted and it is possible to prevent a load being applied to the recording processing part conveyance system due to a sudden change of direction of the recording processing part. Alternatively, the recording processing part can be retracted to an area outside of the medium-supporting part by moving a shorter distance because the recording processing part is retracted to an area outside of the medium-supporting part so as to face in the direction of the edge of the medium-supporting part that is shorter in distance from the recording processing part at a time at which the abnormality has occurred, regardless of the movement direction of the recording processing part at the time at which the abnormality has occurred.

In the recording device as described above, the control unit is preferably configured to carry out the operation to retract the recording processing part when the abnormality occurring in the medium conveyance system is a first type, and to continue the recording process when the abnormality is a second type that is different from the first type.

In accordance with this configuration, an in-process recording process can be completed in the case that the abnormality that has occurred is a negligible abnormality because the recording processing part retract operation and continuation of the recording process is selected in accordance with the type of abnormality that has occurred in the medium conveyance system.

In the recording device as described above, the medium conveyance system preferably includes a motor control unit configured to control operations of at least one of the first drive motor and the second drive motor. The motor control unit is preferably configured to detect the first type of abnormality based on a comparison of a reference electric current value set in advance and an electric current value of the at least one of the first drive motor and the second drive motor after a predetermined time has elapsed from a time at which a control signal for controlling the at least one of the first drive motor and the second drive motor to rotate is outputted, and compute and cumulate load information of the at least one of the first drive motor and the second drive motor based on the electric current value of the at least one of the first drive motor and the second drive motor being controlled, and detect the second type of abnormality based on a comparison of a resulting cumulative value and a reference cumulative value.

The first type of abnormality is an abnormality of the power supply system or the drive system that is detected as an abnormality of the electric current value of the drive motor, and the possibility that the recording medium will be made to flex or the like is high. On the other hand, the second type of abnormality is an abnormality detected in the case that an excessive load has been applied to the drive motor, and will not immediately result in a defect in the operation of the drive motor when detected. In accordance with the configuration described above, a recording device is obtained in which the recording processing part is less likely to be damaged and product waste is reduced because the recording processing part is retracted in the case that the first type of abnormality has been detected, and the recording process is continued in the case that the second type of abnormality has been detected.

In the recording device as described above, the reference electric current value used by the motor control unit is preferably a lower one of a target electric current value of the at least one of the first drive motor and the second drive motor after the predetermined time has elapsed and a maximum electric current value set in accordance with a rotational speed of the at least one of the first drive motor and the second drive motor.

It is thereby possible to prevent misdetection of errors caused by a phenomenon in which the maximum electric current value is reduced when the rotational speed of the motor is high.

In the recording device as described above, the motor control unit is preferably configured to compute the load information $a=i^2\alpha-\beta$, wherein i is an electric current value of the at least one of the first drive motor and the second drive motor, $\alpha$ is an electric current calorimetric coefficient, and $\beta$ is a heat discharge constant, compute a cumulative value A of the load information a, and detect an excessive load of the at least one of the first drive motor and the second drive motor when the cumulative value A of the load information a is greater than a reference cumulative value $A_E$ set in advance.

An excessive load of the drive motor can thereby be detected with relatively higher accuracy than by simple computational processing. Initial settings can be established in a simple manner because the electric current calorimetric coefficient $\alpha$ and the heat discharge constant $\beta$ can be readily set by experimentation.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
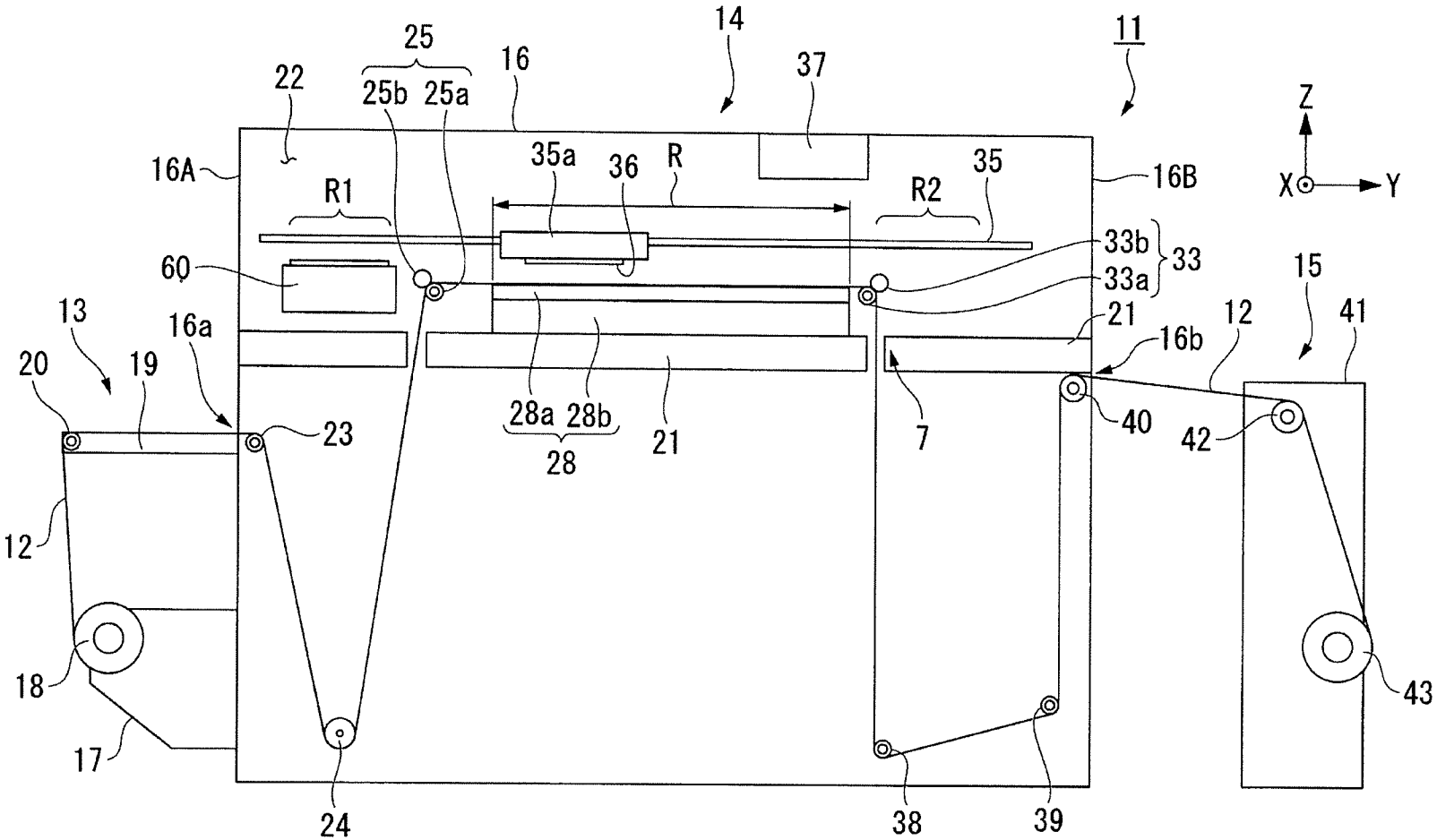
FIG. 1 is a view showing the printer of the embodiment.

Embodiments of the recording device are described hereinbelow with reference to the drawings.

The scope of the present invention is not limited to the embodiments below, and modifications can be made as desired within the scope of the technical concepts of the present invention. The scale, number, and other parameters in the actual structure and each structure may be different in the drawings in order to facilitate understanding of each configuration.

Figure 2:
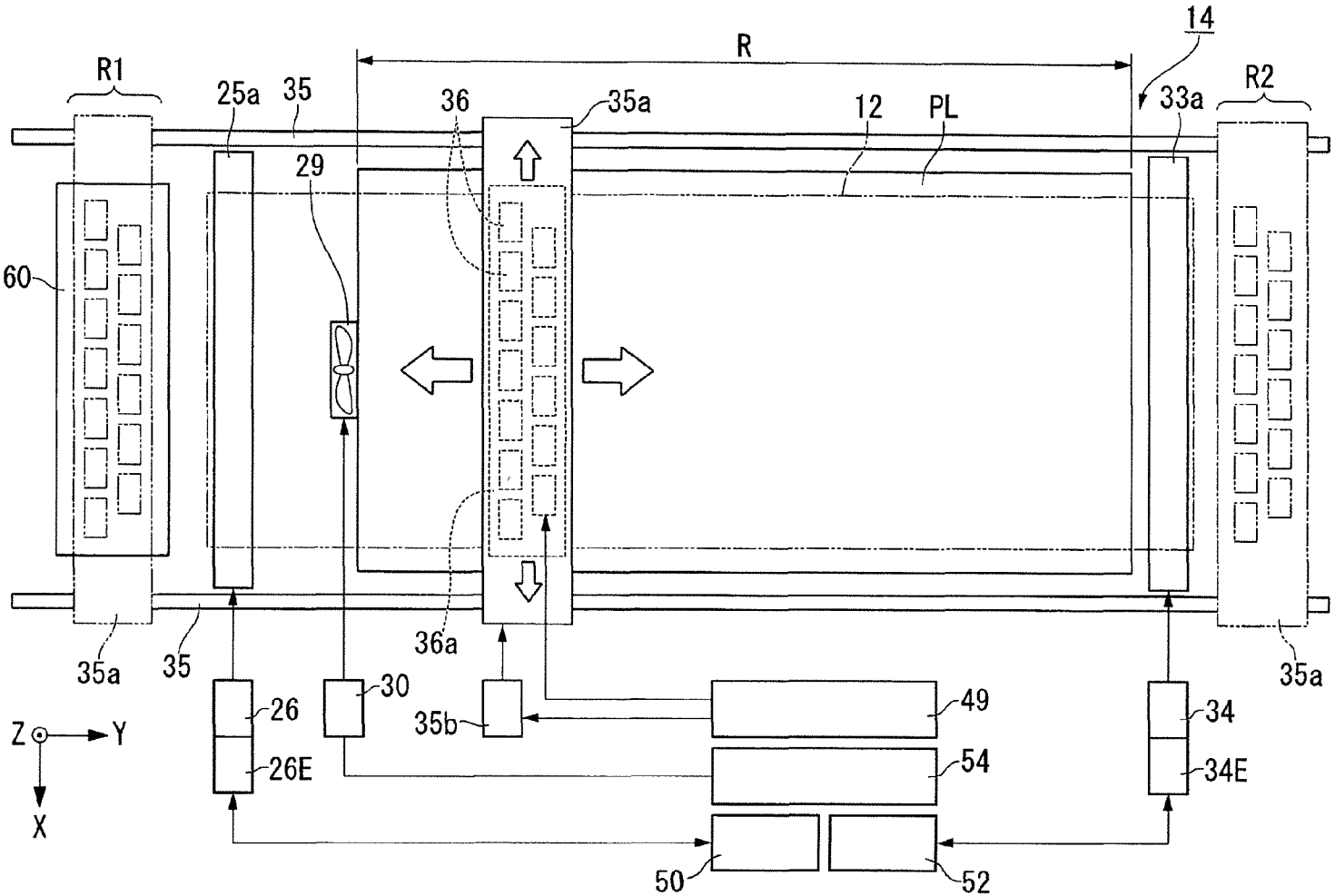
FIG. 2 is a plan view of the print area used for printing in the printer.
Figure 3:
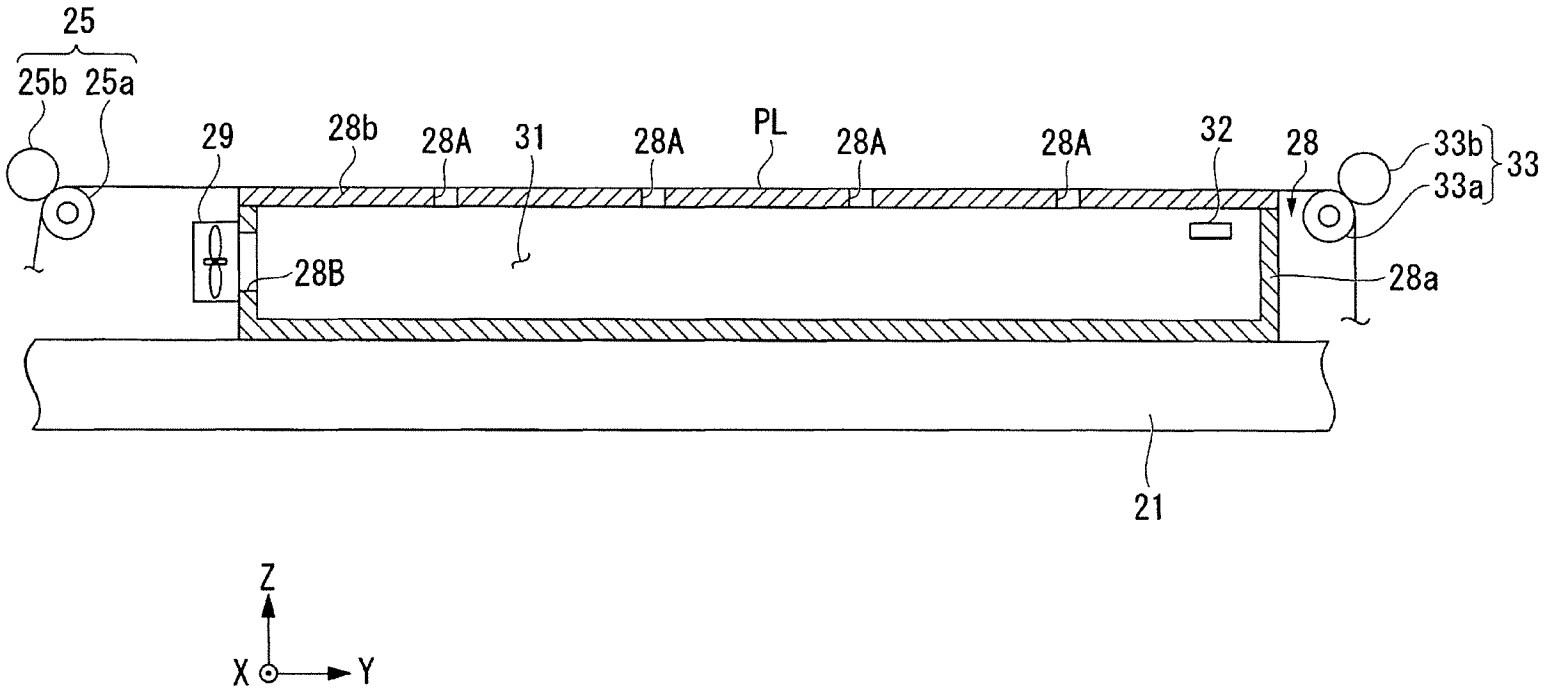
FIG. 3 is a lateral sectional view of the platen.

FIG. 1 is a view showing the printer of the present embodiment. FIG. 2 is a plan view of the print area used for printing in the printer. FIG. 3 is a lateral sectional view of the platen.

A printer 11 (recording device) uses as the print method an inkjet method for jetting a fluid from a plurality of recording heads (fluid jet head) onto a continuous paper 12, carries out a printing process while sequentially feeding out the long continuous paper (recording medium) 12 wound in the form of a roll, and then winds the continuous paper 12 in the form of a roll again after printing.

In the present embodiment, an XYZ rectangular coordinate system is used in which the X direction is the width direction of the continuous paper 12 in the horizontal plane, the Y direction is the conveyance direction of the continuous paper 12 orthogonal to the X direction, and the Z direction is the vertical direction.

The printer 11 is provided with a main unit 14 that carries out the printing process, a feed unit 13 for supplying the continuous paper 12 to the main unit 14, and a winding unit 15 for winding up the continuous paper 12 discharged from the main unit 14.

The main unit 14 is provided with a main case 16, the feed unit 13 is disposed on the upstream side (−Y side) of the conveyance direction of the main case 16, and the winding unit 15 is disposed on the downstream side (+Y side) of the conveyance direction of the main case 16. The feed unit 13 is connected to a medium supply unit 16*a* provided in a sidewall 16A of the upstream side (−Y side) of the conveyance direction of the main case 16, and the winding unit 15 is connected to a medium discharge unit 16*b* provided in a sidewall 16B of the downstream side (+Y side) of the conveyance direction.

The feed unit 13 is provided with a support plate 17 mounted on a lower part of the sidewall 16A of the main case 16, a winding shaft 18 provided to the support plate 17, a feed platform 19 connected to the medium supply unit 16*a* of the main case 16, and a relay roller 20 provided to the distal end of the feed platform 19. The continuous paper 12 wound in the form of a roll is rotatably supported by the winding shaft 18. The continuous paper 12 fed out from the roll is wound about the relay roller 20, diverted to the upper surface of the feed platform 19, and conveyed out to the medium supply unit 16*a* along the upper surface of the feed platform 19.

The winding unit 15 is provided with a winding frame 41, and a relay roller 42 and winding drive shaft 43 provided to the winding frame 41. The continuous paper 12 discharged from the medium discharge unit 16*b* is wound onto the relay roller 42 and directed to the winding drive shaft 43, and then wound into the form of a roll by the rotational driving of the winding drive shaft 43.

A plate-shaped base 21 is horizontally arranged inside the main case 16 of the main unit 14 and the interior of the main case is partitioned by the base 21 into two spaces. The space above the base 21 is a printing chamber 22 for carrying out the printing process on the continuous paper 12. Disposed in the printing chamber 22 are a platen (medium-supporting part) 28 secured onto the base 21, a recording head (recording processing part) 36 disposed above the platen 28, a carriage 35*a* for supporting the recording head 36, a two guide shafts 35 (see FIG. 2) for supporting the carriage 35*a*, and a valve unit 37. The two guide shafts 35 are arranged parallel to each other along the conveyance direction (Y direction) and are configured so as to allow the carriage 35*a* to move in a reciprocating fashion in the conveyance direction. In the case of the present embodiment, the carriage 35*a* and the two guide shafts 35 belong to the recording processing part conveyance system for conveying the recording head 36.

The platen 28 has: a box-shaped support base 28*a* having an open upper surface; and a placement plate 28*b* mounted on the opening of the support base 28*a*, as shown in FIGS. 1 to 3. The support base 28*a* is secured onto the base 21, the interior enclosed by the support base 28*a* and the placement plate 28*b* is a negative pressure chamber 31. The continuous paper 12 is placed on a support surface PL (upper surface in the drawing) of the placement plate 28*b*.

Numerous through-holes 28A are formed in the placement plate 28*b* in the thickness direction of the placement plate 28*b*, and an exhaust port 28B is formed through one sidewall (sidewall of the −Y side in the present embodiment) of the support base 28*a*. The interior of the negative pressure chamber 31 is suctioned by a suction fan 29, whereby a suction force is made to act on the continuous paper 12 via the numerous through-holes 28A, and the continuous paper 12 can be chucked to and flattened against the support surface PL of the placement plate 28*b*.

A supply conveyance system that includes a plurality of conveyance rollers is disposed on the upstream side (−Y side) of the conveyance direction of the platen 28. The supply conveyance system includes a first conveyance roller pair 25 disposed inside the printing chamber 22 in the vicinity of the platen 28, a relay roller 24 disposed in the lower-area space of the main case 16, and a relay roller 23 disposed in the vicinity of the medium supply unit 16*a*.

The first conveyance roller pair 25 is composed of a first drive roller 25*a* and a first driven roller 25*b*. A first conveying motor (first drive motor) 26 and a first encoder 26E are connected to the first drive roller 25*a*, as shown in FIG. 2.

In the supply conveyance system, the continuous paper 12 conveyed into the main case 16 from the feed unit 13 via the medium supply unit 16*a* is wound onto the first drive roller 25*a* from below via the relay rollers 23, 24 and nipped by the first conveyance roller pair 25. The continuous paper 12 is fed out in parallel fashion from the first conveyance roller pair 25 onto the support surface PL of the platen 28 in accompaniment with the rotation of the first drive roller 25*a* driven by the first conveying motor 26.

On the other hand, the discharge conveyance system includes a plurality of conveyance rollers on the downstream side (+Y side) of the conveyance direction of the platen 28. The discharge conveyance system includes a second conveyance roller pair 33 provided on the side opposite from the first conveyance roller pair 25 in relation to the platen 28, an inversion roller 38 and a relay roller 39 disposed in the lower-area space of the main case 16, and a feed roller 40 disposed in the vicinity of the medium discharge unit 16*b*.

The second conveyance roller pair 33 is composed of a second drive roller 33*a* and a second driven roller 33*b*. A second conveying motor (first drive motor) 34 and a second encoder 34E are connected to the second drive roller 33*a*, as shown in FIG. 2. The second driven roller 33*b* is arranged on the print surface side (upper surface side) of the continuous paper 12 and may therefore be configured to make contact with only the edges of the continuous paper 12 in the width direction (X direction) in order to avoid damage to the printed image.

In the discharge conveyance system, the second conveyance roller pair 33 having nipped the continuous paper 12 conveys the continuous paper 12 off the platen 28 in accompaniment with the rotation of the second drive roller 33*a* driven by the second conveying motor 34. The continuous paper 12 fed out from the second conveyance roller pair 33 is conveyed to the feed roller 40 by way of the inversion roller 38 and the relay roller 39, and is fed out by the feed roller 40 to the winding unit 15 via the medium discharge unit 16*b*.

In the present embodiment, the supply conveyance system including the first conveyance roller pair 25 and the discharge conveyance system including the second conveyance roller pair 33 belong to a medium conveyance system for conveying the continuous paper 12 as the recording medium inside the main unit 14.

Next, in the case of the present embodiment, a plurality of recording heads 36 is mounted on the carriage 35*a* via a head mounting plate 36*a*. The head mounting plate 36*a* is configured to allow movement in the width direction (X direction) of the medium on the carriage 35*a*. The head mounting plate 36*a* can be positionally controlled by a head position control unit 35*b* connected to the carriage 35*a*, and the head mounting plate 36*a* is moved in the width direction (X direction) of the medium, whereby the plurality of recording heads 36 can be integrally moved to a new line. The recording heads 36 are arranged in a line at fixed intervals in the width direction of the medium so that mutually adjacent recording heads 36 form two mutually different steps in the conveyance direction (Y direction) of the medium.

The head position control unit 35*b* carries out positional control of the recording heads 36 in the width direction (X direction) of the medium and positional control of the carriage 35*a* in the conveyance direction (Y direction; head scan direction) of the medium, and can arrange the recording heads 36 in a desired position on the continuous paper 12.

The plurality of recording heads 36 is connected to the valve unit 37 via the supply tubes (not shown). The valve unit 37 is disposed on the interior wall of the main case 16 inside the printing chamber 22, and is connected to the ink tank (ink reservoir unit; not shown). The valve unit 37 temporarily stores and supplies ink supplied by the ink tank to the recording heads 36.

Numerous ink discharge nozzles are arrayed on the lower surface (nozzle formation surface) of the recording head 36 in the width direction (X direction) of the medium. The recording heads 36 jet ink supplied by the valve unit 37 from the ink discharge nozzles toward the continuous paper 12 on the platen 28 to carry out printing.

The recording heads 36 may have a plurality of rows of ink discharge nozzles. In this case, ink is assigned for each color in each row of ink discharge nozzles, whereby a plurality of colors of ink can be jetted using a single recording head 36 when four or six colors are used in color printing.

In the printing chamber 22, the region on the platen 28 is the print region R in which printing is carried out on the continuous paper 12 by ink jetting from the ink discharge nozzles. The continuous paper 12 is conveyed intermittently by the above-described supply conveyance system and discharge conveyance system. Specifically, the continuous paper 12 is loaded onto the platen 28 each time continuous paper 12 having a length corresponding to the print region R undergoes printing, and is then conveyed away to the discharge conveyance system after completion of the printing process.

The guide shaft 35 extending inside the printing chamber 22 extends further outside the print region R in the conveyance direction of the medium, as shown in FIGS. 1 and 2. The carriage 35*a* can thereby move to the region outside of the print region R. A first maintenance region R1 is disposed on the upstream side (−Y side) of the medium conveyance direction of the print region R, and a second maintenance region R2 is disposed on the downstream side (+Y side) of the medium conveyance direction.

A maintenance unit 60 is disposed in the first maintenance region R1. The maintenance unit 60 is provided with, e.g., a cap member and wiping member arranged in corresponding fashion to each recording head 36, and a suction device connected to the cap member and used for suctioning the interior of the cap member.

The second maintenance region R2 is not provided with a maintenance unit or the like and is used as workspace for a worker's hands and arms. The carriage 35*a* is arranged in the second maintenance region R2, whereby the nozzle formation surface of the recording heads 36 can be exposed inside the workspace, and the nozzle formation surface can be cleaned, the recording heads 36 can be replaced, or other work may be carried out by a worker.

The continuous paper 12 that has been subjected to the printing process is naturally dried during conveyance through the discharge conveyance system, but it is also possible to use a configuration in which a heating device is provided for forcibly drying and securing the ink to the continuous paper 12. For example, it is possible to provide a platen heater to the platen 28 to heat the placement plate 28*b*, or to provide a heating device inside the discharge conveyance system.

Figure 4:
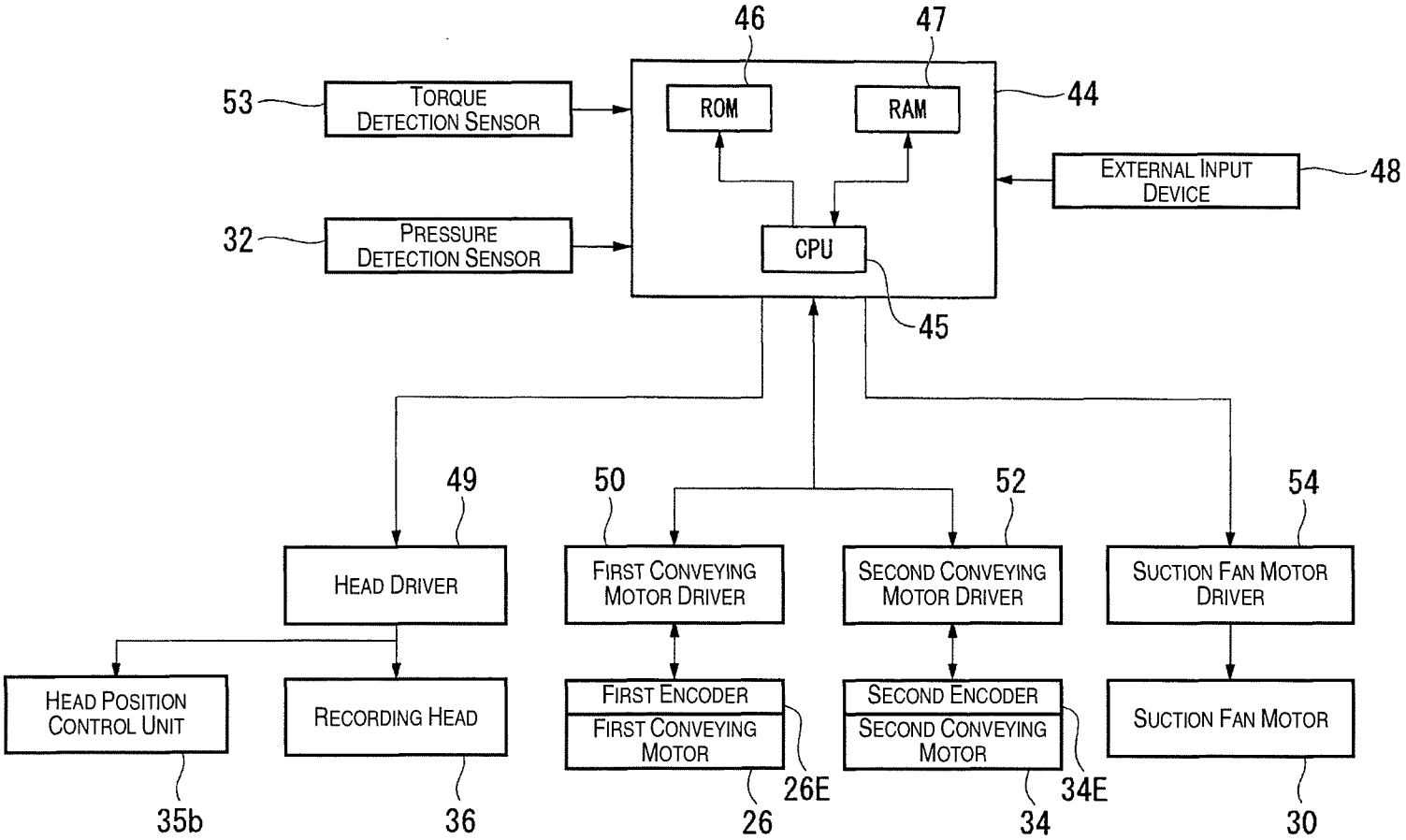
FIG. 4 is a function block diagram of the printer.

Next, FIG. 4 is a function block view of the printer 11.

Figure 5:
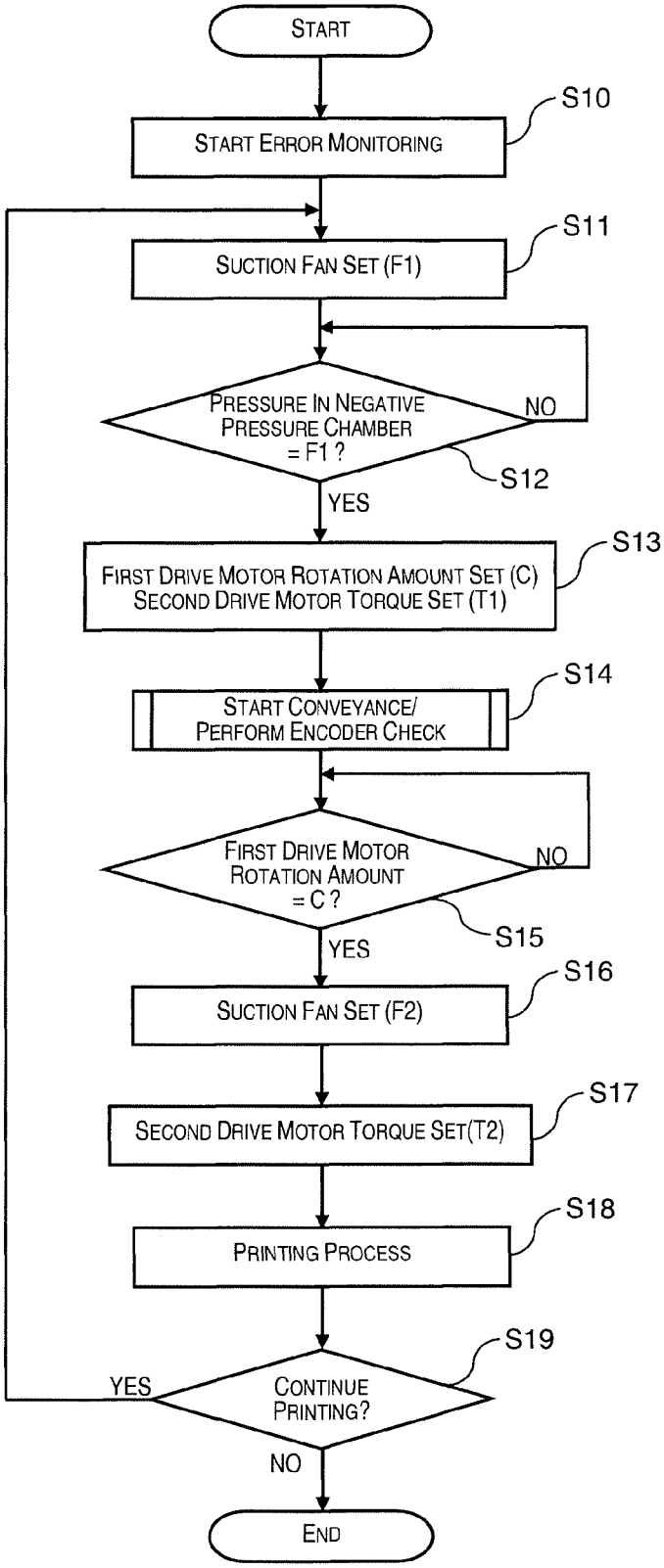
FIG. 5 is a flowchart showing the processing routine related to the conveyance and the printing processes.

The printer 11 is provided with a controller 44 for controlling the drive state of the device overall, as shown in FIG. 4. The controller 44 is provided with a CPU 45, which is the central processing unit, a ROM 46, and a RAM 47. Programs and other processing routines related to the printing process and the conveyance process shown in the flowchart of FIG. 5 are stored in the ROM 46. The RAM 47 is used as a temporary storage area for computation results in the CPU 45, and a temporary storage area for print data or the like inputted from an external input device 48.

Connected to the controller 44 are a head driver 49, a first conveying motor driver (first motor control unit) 50, a second conveying motor driver (second motor control unit) 52, a suction fan motor driver 54, a torque detection sensor 53, the pressure detection sensor 32, and the external input device 48.

The plurality of recording heads 36 and the head position control unit 35*b* are connected to the head driver 49. The controller 44 reads print data inputted from the external input device 48 from the RAM 47 in the printing process, and transmits the print data thus read to the head driver 49. The head driver 49 drives the recording heads 36 and the head position control unit 35*b* based on the print data received from the controller 44, causes ink droplets to be jetted from the ink discharge nozzles of the recording heads 36 while controlling the position of the recording heads 36 above the continuous paper 12, and forms an image on the continuous paper 12.

The first conveying motor driver 50 detects the amount of rotation of the first conveying motor 26 on the basis a count signal outputted from the first encoder 26E connected to the first conveying motor 26, and controls the amount of rotation of the first conveying motor 26 using feedback. In other words, the first conveying motor driver 50 rotatably drives the first drive roller 25*a* via the first conveying motor 26 and feeds out the continuous paper 12 from the first conveyance roller pair 25 onto the platen 28 until a predetermined conveyance length inputted from the controller 44 is reached.

On the other hand the second conveying motor driver 52 drives the second conveying motor 34 using torque control based on a control signal inputted from the controller 44. In the present embodiment, the torque detection sensor 53 for detecting the torque of the second conveying motor 34 is connected to the controller 44, and the controller 44 controls the torque of the second conveying motor 34 by using feedback via the second conveying motor driver 52 based on the result of detecting the torque of the second conveying motor 34 outputted from the torque detection sensor 53. A predetermined tension based on the torque of the second conveying motor 34 is thereby imparted to the continuous paper 12 via the second drive roller 33*a*.

Generally, since the torque and electric current of the motor have a substantially proportional relationship, the magnitude of the electric current is determined in accordance with the motor load as long as the rotational speed of the motor is constant. In other words, the magnitude of the electric current required to drive the motor is determined in accordance with the load imposed on the roller. Therefore, the magnitude of the load applied to the motor can be detected by detecting the magnitude of the electric current that flows through the motor. In view of the above, in the present embodiment, an electric current sensor of the second conveying motor driver 52 that is used for detecting the magnitude of the electric current that flows to the second conveying motor 34 is used as the torque detection sensor 53. The controller 44 thereby sets the electric current value of the second conveying motor 34 as the torque setting value in the second conveying motor driver 52, and the second conveying motor driver 52 controls the second conveying motor 34 by using feedback based on the inputted electric current value.

In the present embodiment, the second encoder 34E connected to the second conveying motor 34 cannot be used for detecting the feed length when the continuous paper 12 is conveyed because the second conveying motor 34 is driven by torque control, but is used for initialization operation of the second conveying motor 34 or stop control of the second drive roller 33*a* when the device is started up.

The suction fan motor driver 54 drivably controls a suction fan motor 30 connected to the rotating shaft of the suction fan 29 based on control signal inputted from the controller 44. The suction fan 29 is rotated at a predetermined speed by the driving force of the suction fan motor 30, whereby the pressure inside the negative pressure chamber 31 can be reduced by predetermined suction force based on the rotational speed. As a result, the negative pressure inside the negative pressure chamber 31 acts on the continuous paper 12 as a chucking force on the support surface PL of the platen 28 via the through-holes 28A of the placement plate 28*b*.

Next, conveyance control and print control in the printer 11 of the present embodiment will be described with reference to FIG. 5. FIG. 5 is a flowchart showing the processing routine related to the conveyance and the printing processes.

The controller 44 reads and executes the program of a processing routine related to the conveyance process and the print process from the ROM 46, whereby conveyance control and print control are carried out in the printer 11. Although not shown in the drawings, the print data used for printing on the continuous paper 12 is inputted from the external input device 48 to the RAM 47 when the controller 44 executes a program of a processing routine related to the conveyance process and the print process, and the print data is supplied to the recording heads 36 via the head driver 49.

First, in step S10, the controller 44 outputs a control signal for starting an error monitoring routine to the first conveying motor driver 50 and the second conveying motor driver 52, as shown in FIG. 5. The first conveying motor driver 50 and the second conveying motor driver 52 having received the control signal start an error monitoring routine for monitoring errors in the first conveying motor 26 and the second conveying motor 34, which are connected to the first conveying motor driver 50 and second conveying motor driver 52, respectively.

In the error monitoring routine, the first conveying motor driver 50 and the second conveying motor driver 52 measure the electric current that flows to the first conveying motor 26 and second conveying motor 34 at predetermined times (e.g., every 50 μs), and executes a computation routine using the acquired electric current values. An error is judged by comparing the computation result with reference values set in advance, and in the case that an error has been detected, the controller 44 is notified of the error occurrence.

When execution of the error monitoring routine is started, other processing routines are executed independently at predetermined times in the first conveying motor driver 50 and the second conveying motor driver 52. When an error is detected by the error monitoring routine, the first conveying motor driver 50 and the second conveying motor driver 52 notifies the controller 44 about the error that occurred. The controller 44 starts an error processing routine (see FIG. 12) when error notification is received from the first conveying motor driver 50 or the second conveying motor driver 52. The operation that corresponds to the type of error thus received is stipulated in the error processing routine.

Here, the error monitoring routine will be described with reference to FIGS. 6 to 9.

Figure 6:
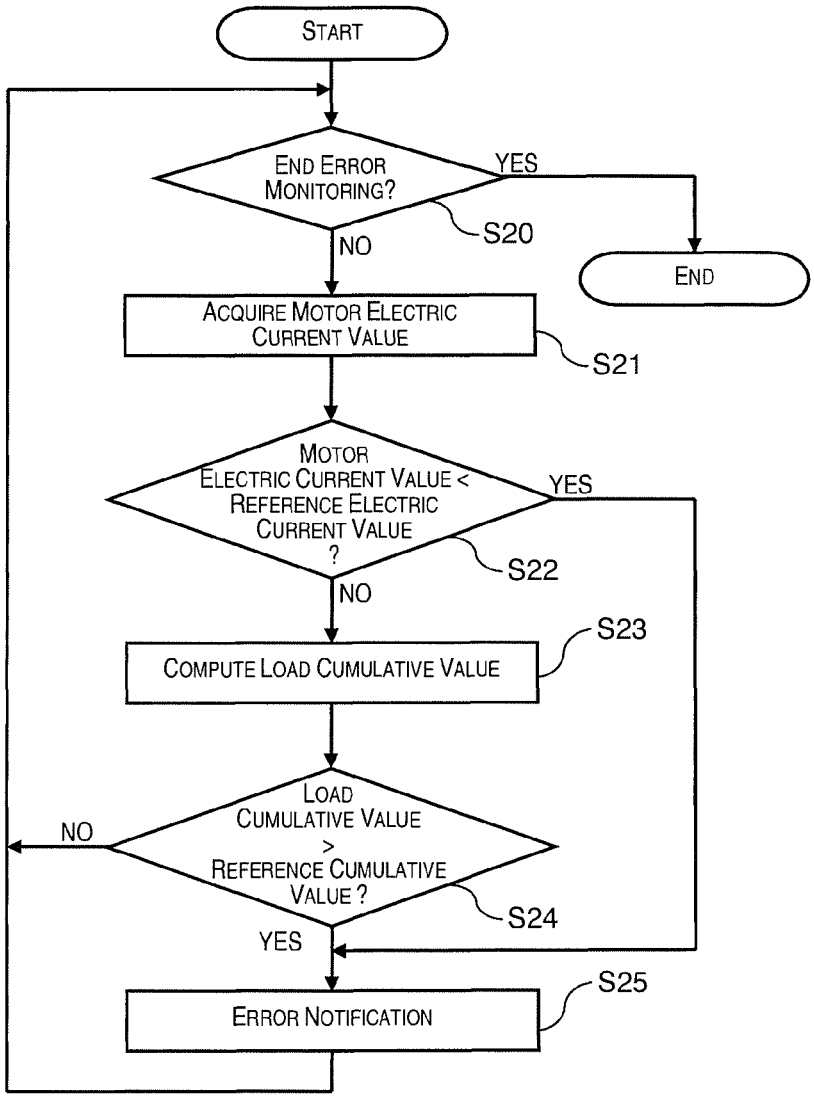
FIG. 6 is a flowchart showing the error monitoring routine.
Figure 7:
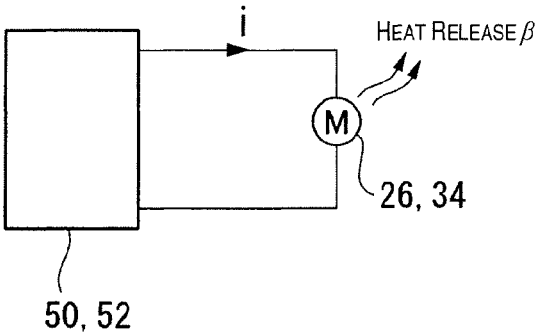
FIG. 7 is a schematic diagram of the step for acquiring the value of the motor electric current.

FIG. 6 is a drawing showing the error monitoring routine executed by the first conveying motor driver 50 and the second conveying motor driver 52. FIG. 7 is a schematic view of the step for acquiring the value of the motor electric current.

The error monitoring routine in the first conveying motor driver 50 and the first conveying motor 26 is described in detail below, but unless otherwise noted, the same applies to the second conveying motor driver 52 and the second conveying motor 34.

The error monitoring routine of the present embodiment includes steps S20 to S25.

First, in step S20, it is judged whether a control signal for instructing the end of the error monitoring routine has been inputted. The error monitoring routine is ended in the case that a control signal for instructing the end of processing has been inputted from the controller 44 to the first conveying motor driver 50. The process otherwise proceeds to step S21.

Next, in step S21, the first conveying motor driver 50 acquires the electric current value i of the first conveying motor 26, which is to be driven, as shown in FIG. 7. In the case of the present embodiment, the first conveying motor 26 and second conveying motor 34 are both DC motors and the acquired electric current value i is a DC value.

Next, in step S22, the electric current value i acquired in step S21 and the reference electric current value are compared, and the existence of a power source abnormality of the motor is judged. Here, FIG. 8 is a diagram of the step for judging a power source abnormality of the motor, wherein FIG. 8A is a diagram of the target electric current value used as the reference electric current value, and FIG. 8B is a diagram of the maximum electric current value used as the reference electric current value.

Figure 8A:
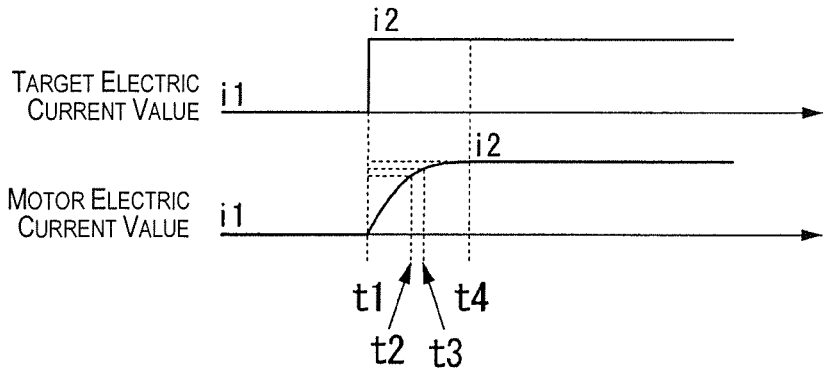
FIGS. 8A and 8B are diagrams illustrating the step for judging a power source abnormality in the motor.
Figure 8B:
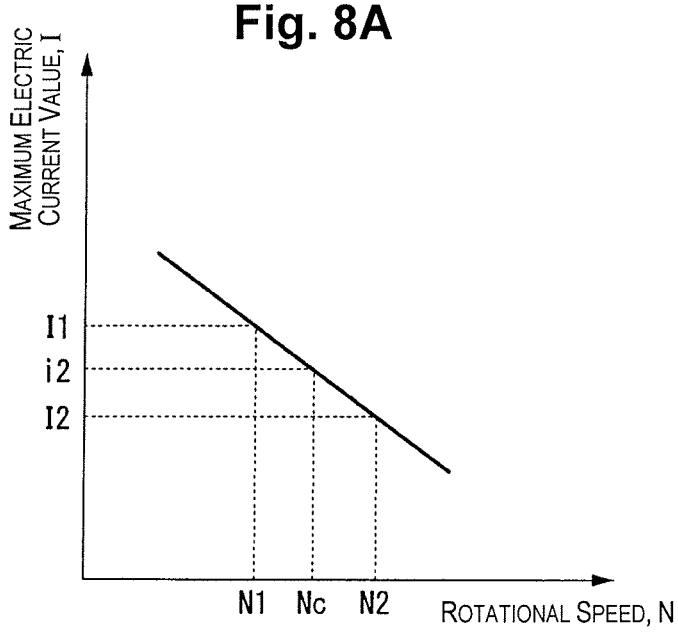

The target electric current value shown in FIG. 8A is used in principle as the reference electric current value of step S22. The target electric current value is a command value for electric current control inputted from the controller 44 to the first conveying motor driver 50, and is alternatively a value obtained by multiplying a predetermined coefficient with the command value.

In the example shown in FIG. 8A, a command value (target electric current value) i2 is inputted from the controller 44 to the first conveying motor driver 50 at time t1. At this time, the first conveying motor driver 50 begins the driving of the first conveying motor 26 and the electric current value i that flows to the first conveying motor 26 gradually increases. The electric current value i reaches the target electric current value i2 at time t4.

In step S22, in view of the rising curve of such an electric current, the electric current value i and the target electric current value i2 are compared at a time (time t4 or a time thereafter) after a predetermined length of time has elapsed from the time point at which the target electric current value was inputted (time t1), and it is judged whether the electric current value i is less than the target electric current value i2.

In the case that the electric current value i has not reached the target electric current value i2, it is determined that, e.g., the power source line of the first conveying motor 26 may be severed, the brushes of the first conveying motor 26 may be abraded, or another abnormality may have occurred; and the process omits steps S23, S24 and proceeds to step S25. On the other hand, it is determined that the power source system of the first conveying motor 26 is normal in the case that the electric current value i has reached the target electric current value i2 and the process proceeds to step S23.

In the description above, the command value i2 is used as the target electric current value, but rather than directly using the command value, it is also possible to use a value obtained by multiplying the command value by a predetermined coefficient. Specifically, a value obtained by 0.8×i2 (factor of 0.8) or 0.9×i2 (factor of 0.9) may be used as the target electric current value. When the target electric current value is set to be these values, the time at which the electric current value i reaches the target electric current value is time t2 in the case of 0.8×i2 and time t3 in the case of 0.9×i2, which are times earlier than time t4, as shown in FIG. 8A. Therefore, the target electric current value is set to a value that is less than the command value as noted above, thereby making it possible to shorten the time until the state of the electric current value i is judged after the driving of the first conveying motor 26 has started.

The electric current value that flows with dependence on the rotational speed varies in a DC motor. Specifically, the maximum electric current value I decreases in proportion to the magnitude of the rotational speed N and electric current flows with greater difficulty, as shown in FIG. 8B. Accordingly, in the case that the command value i2 shown in FIG. 8A, for example, is a value between the maximum electric current values I1, I2, the electric current value i only increases to the maximum electric current value I2 and does not reach the command value i2, which is the target electric current value, when the rotational speed of the first conveying motor 26 is N2 at the time steps S21, S22 described above are executed. An error (motor power source abnormality) will be detected at this time when the electric current value i and the target electric current value i2 are merely compared.

In view of this situation, in the case that such a phenomenon is envisioned, the reference electric current value of step S22 is set to be the lesser of the target electric current value based on the command value inputted from the controller 44 and the maximum electric current value established in accordance with the rotational speed of the motor. In other words, the maximum electric current value I is set as the reference electric current value of step S22 in the case that the maximum electric current value I is acquired from the rotational speed of the motor at the time of step S21 and the relationship shown in FIG. 8B when step S21 is executed and in the case that the maximum electric current value I is less than the target electric current value. It is thereby possible to prevent error misdetection in step S22.

Next, in step S23, a cumulative load value is computed in order to estimate the state of the temperature load on the first conveying motor 26.

In the cumulative load value of step S23, the first conveying motor driver 50 computes the load information $a=i^2\alpha-\beta$ using the electric current value i acquired in step S21, the electric current calorimetric coefficient $\alpha$ set in advance, and the heat discharge constant $\beta$. The cumulative value A is computed by adding the computed load information a each time the step is executed.

The electric current calorimetric coefficient $\alpha$ in the formula of the load information a is a coefficient related to the heat output and the amount of electric current that flows. The electric current calorimetric coefficient $\alpha$ can be computed based on the winding resistance value of the first conveying motor 26, but more realistic load information a can be computed by correcting the electric current calorimetric coefficient $\alpha$ based on a measured value of the heat output when the electric current value i has been changed. On the other hand, the heat discharge constant $\beta$ is the amount of heat released by the first conveying motor 26 per unit of time. The heat discharge constant $\beta$ varies in accordance with the type of first conveying motor 26 and the configuration of the cooling system, and it is possible to obtain the constant by experimentation in accordance with the configuration of the printer.

In other words, the load information a is obtained by subtracting the amount of heat release ($\beta$) per unit of time from the heat output ($i^2\alpha$) of the first conveying motor 26 per unit of time, and corresponds to the accumulated amount of heat of the first conveying motor 26 per unit of time. The cumulative value A corresponds to the amount of heat accumulated in the first conveying motor 26 due to operation and may be used as a parameter for estimating the load on the first conveying motor 26 due to heat output.

In the first conveying motor driver 50, the load information a is a negative value in the case that $i^2\alpha$, which corresponds to the heat output, is less than the heat discharge constant $\beta$, which corresponds to the amount of heat released. However, the cumulative value A, which is cumulative load information a, is computed and processed so as avoid becoming less than zero. This is done because the amount of heat accumulated in the motor can no longer be accurately reflected when the cumulative value A is a negative value because the temperature of the first conveying motor 26 does not fall below the environmental temperature. In view of this fact, zero (0) is set as the cumulative value A in the case that the value obtained by adding the load information a to the cumulative value A is negative.

Next, in step S24, the first conveying motor driver 50 compares the cumulative A computed in step S23 and the reference cumulative value $A_E$ set in advance. The reference cumulative value $A_E$ is a cumulative value in which the motor is judged to be in an overload state due to heat output, and can be obtained by experimentation in accordance with the heat resistance or the like of the first conveying motor 26.

The process proceeds to step S25 in the case that the cumulative value A exceeds the reference cumulative value $A_E$. On the other hand, the first conveying motor 26 is determined to be operating normally in the case that the cumulative value A is equal to or less than the reference cumulative value $A_E$, and the process returns to step S20.

Next, an error notification operation is carried out in step S25. In other words, the first conveying motor driver 50 notifies the controller 44 about an error that has occurred in the case that the electric current value i of the first conveying motor 26 does not reach the reference electric current value in step S22 (S22; Yes), or in the case that the cumulative value A exceeds the reference cumulative value $A_E$ in step S24 (S24; Yes).

The first conveying motor driver 50 notifies the controller 44 of the error information showing that there is an abnormality in the power source of the first conveying motor 26 in the case that an error has been judged in step S22, and provides notification of error information showing that the first conveying motor 26 is in an overload state in the case that an error has been judged in step S24.

Again in FIG. 5, in step S11, the controller 44 transmits a control signal to the suction fan motor driver 54, whereupon a negative pressure is generated in the negative pressure chamber 31 when the suction fan 29 begins rotating in accompaniment with the rotational driving of the suction fan motor 30. As a result, a chucking force acts on the continuous paper 12 on the support surface PL of the platen 28 from inside the negative pressure chamber 31 via the through-holes 28A of the placement plate 28*b*. In this case, the continuous paper 12 is chucked onto support surface PL of the platen 28 by a second chucking force substantially equal to a suction force F1 of the suction fan 29.

The controller 44 confirms the pressure inside the negative pressure chamber 31 in step S12 based on the detection signal from the pressure detection sensor 32 disposed inside the negative pressure chamber 31. The controller 44 repeatedly confirms the pressure of the negative pressure chamber 31 until the pressure inside the negative pressure chamber 31 reaches a pressure value substantially equal to the suction force F1 of the suction fan 29. When it is confirmed that the negative pressure chamber 31 is at a pressure equal to the suction force F1, it is determined that pressure reduction by the suction fan 29 has been completed and the process proceeds to step S13.

Next, the controller 44 sets the amount of rotation of the first conveying motor 26 to C in step S13 to thereby set the conveyance distance (feed length) of the continuous paper 12 by the first drive roller 25*a*. The rotation amount C of the first conveying motor 26 is set so that the conveyance distance of the continuous paper 12 by the first drive roller 25*a* is a length that corresponds to the print region R from the left end of FIG. 1 (downstream-side end of the conveyance direction) of the platen 28 to the right end (upstream-side end of the conveyance direction) in the case that the first drive roller 25*a* has been rotatably driven in accompaniment with the rotational driving of the first conveying motor 26. In the case of the present embodiment, the rotation amount C is inputted to the first conveying motor driver 50 as the count value of the first encoder 26E.

The controller 44 sets T1 to be the governing torque value of the second conveying motor 34 in step S13 to thereby set the magnitude of the tension that operates on the continuous paper 12 from the second drive roller 33*a*.

The governing torque value T1 of the second conveying motor 34 is set so that the magnitude of the tension that operates on the continuous paper 12 from the second drive roller 33*a* based on the torque of the second conveying motor 34 is a magnitude that can sufficiently keep the continuous paper 12 from flapping during conveyance. In the case of the present embodiment, the governing torque value T1 is inputted to the second conveying motor driver 52 as the target electric current value of the second conveying motor 34.

Figure 9:
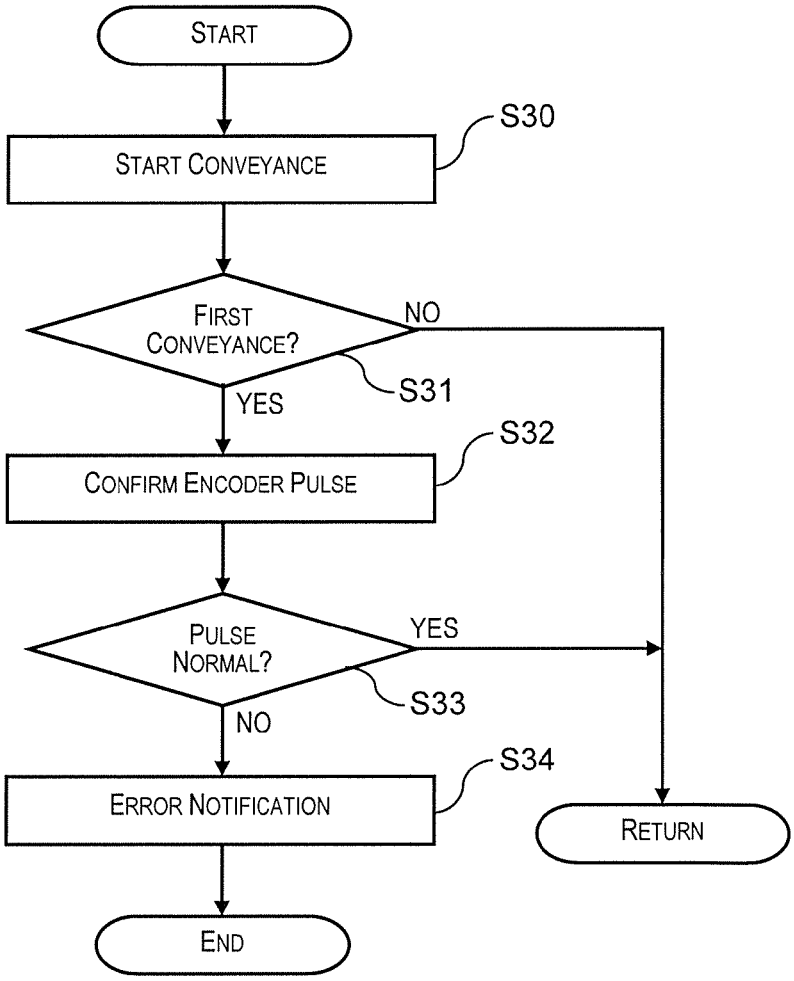
FIG. 9 is a flowchart showing the details of the encoder check routine.

Next, FIG. 9 is a flowchart showing the details of step S14. In step S14, an operation for starting conveyance of the continuous paper 12 and an encoder check operation are carried out by the processing routines of steps S30 to S34 shown in FIG. 9.

First, in step S30 shown in FIG. 9, the controller 44 transmits a control signal for starting conveyance to the first conveying motor driver 50 and the second conveying motor driver 52. At this time, the first drive roller 25*a* begins rotational driving in accompaniment with the rotational driving of the first conveying motor 26, whereby conveyance of the continuous paper 12 onto the platen 28 is started. Also, the second drive roller 33*a* begins rotational driving in accompaniment with the rotational driving of the second conveying motor 34, whereby the second drive roller 33*a* applies tension to the continuous paper 12.

Next, in step S31, the controller 44 judges whether the ongoing operation is a first conveyance operation or a second or later conveyance operation in which continuous printing is carried out. In the case that the ongoing operation is a first conveyance operation, the process proceeds to step S32 and the encoder carries out a check operation. On the other hand, the operations of step S32 and thereafter are skipped in the case that the ongoing operation is a second or later conveyance operation, and the process proceeds to step S15 of the processing routine shown in FIG. 5.

In other words, the encoder check operation is executed only when the first conveyance operation is carried out and is not executed in the second or later conveyance operations in the case that conveyance and printing of the continuous paper 12 is to be repeatedly carried out.

Next, when the process proceeds to step S32, the controller 44 transmits a control signal for checking the encoder to the first conveying motor driver 50 and the second conveying motor driver 52. The first conveying motor driver 50 and second conveying motor driver 52 having received the control signal then confirm the count signal of the respectively connected first encoder 26E and second encoder 34E.

Figure 10:
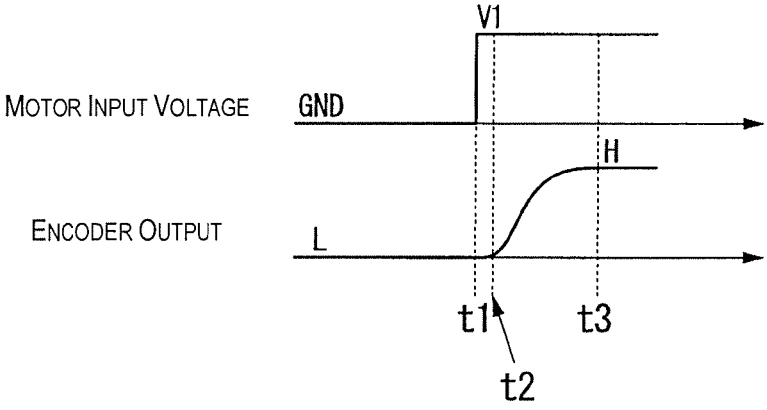
FIG. 10 is a diagram illustrating the change in the encoder output at the start of conveyance.

Specifically, for example, the first conveying motor driver 50 confirms whether a periodic pulse is being sent in relation to the plurality of count signals (A phase, B phase, and the like) of the first encoder 26E. Here, FIG. 10 is a view illustrating the change in the encoder output at the start of conveyance. In the case that the first conveying motor 26 is rotated from a stopped state, the count signal from the first encoder 26E is not immediately outputted from the time point (time t1) of voltage input even if a drive voltage V1 is inputted to the first conveying motor 26, and the pulse rises from time t2 at which a predetermined time (dead time) has elapsed and thereafter reaches a high level at time t3, as shown in FIG. 10. This is due to the fact that the gear or roller, and the first encoder 26E are connected to the drive shaft of the first conveying motor 26. The same applies to the operation of the second conveying motor driver 52 and second conveying motor 34.

In view of the above, the first conveying motor driver 50 (second conveying motor driver 52) starts the rotational driving of the first conveying motor 26 (second conveying motor 34) based on the control signal for starting conveyance, and thereafter confirms the count signal of the first encoder 26E (second encoder 34E) after a longer time than the dead time noted above has elapsed.

Next, in step S33, the first conveying motor driver 50 (second conveying motor driver 52) judges whether the plurality of count signals of the first encoder 26E (second encoder 34E) are being outputted in normal fashion. The process proceeds to step S15 shown in FIG. 5 in the case that it has been judged that the pulse of the count signals are being outputted in a normal fashion. On the other hand, in the case that the pulse has not been detected in at least some of the count signals, it is judged that there is an abnormality in the first encoder 26E or the second encoder 34E, and the process proceeds to step S34.

Examples of the case in which an abnormality is detected in the output pulse of the encoder include (e1) the case in which the power source of the encoder itself has been cut off; (e2) the case in which a paper jam or the like prevents the continuous paper 12 from being feed and the first conveying motor 26 or the second conveying motor 34 are locked; and (e3) the case in which the power source of the A-phase or B-phase pulse output unit has been cut off, each of the cases occurring in the first encoder 26E or the second encoder 34E.

In the cases of (e1) and (e2), the pulse of the count signal is entirely undetected by the target encoder. In the case of (e3), the pulse that should be detected from the pulse output unit in which the power source has been cut off is not detected. It is therefore possible to detect defects of (e1) to (e3) by confirming the pulse of the count signals after a predetermined length of time has elapsed from the start of conveyance.

Next, in step S34, the first conveying motor driver 50 and the second conveying motor driver 52 transmit the generated error information to the controller 44. The controller 44 having received the error information notifies a user about the occurrence of an error and stops the processing routine shown in FIG. 5. This is due to the fact that the errors of (e1) to (e3) detected in the check operation of the encoder are errors in which continuation of the conveyance operation is impossible.

For example, in the case of the errors of (e1) and (e3), the first drive roller 25*a* and/or the second drive roller 33*a* are rotatably driven in spite of the defect in the encoder, and the continuous paper 12 may continue to be conveyed in an uncontrolled state. In such a case, it is possible that the continuous paper 12 will flex on the platen 28 and make contact with the recording heads 36. In the case of the error of (e2) as well, there is a possibility that an excessive load will be applied to the continuous paper 12. It is therefore necessary to rapidly stop conveyance in the case that any of the errors has occurred.

Returning again to FIG. 5, in the subsequent step S15, the controller 44 judges whether the rotation amount of the first conveying motor 26 has reached the rotation amount C set in step S13 from the rotation amount information of the first conveying motor 26 transmitted from the first conveying motor driver 50.

The controller 44 determines that the conveyance of the continuous paper 12 by the first drive roller 25*a* has not been completed in the case that the judgment result in step S15 is a negative judgment (the rotation amount of the first conveying motor 26 does not equal C), and conveyance of the continuous paper 12 by the first drive roller 25*a* continues until the conveyance distance of the continuous paper 12 reaches a desired conveyance distance by the first drive roller 25*a*.

On the other hand, the controller 44 determines that the conveyance of the continuous paper 12 has been completed in the case that the judgment result in step S15 is a positive judgment (the rotation amount of the first conveying motor 26 equals C), and the process proceeds to step S17. At this time, the first conveying motor driver 50 determines that the rotational driving of the first conveying motor 26 based on the command value inputted from the controller 44 is completed and stops the first conveying motor 26. The conveyance of the continuous paper 12 thereby also stopped.

In addition to progressively monitoring the rotation amount of the first drive roller 25*a*, in the operation for conveying the continuous paper 12, the controller 44 also progressively monitors the magnitude of the tension that operates on the continuous paper 12 from the second drive roller 33*a* based on the detection signal from the torque detection sensor 53, and furthermore progressively monitors pressure change inside the negative pressure chamber 31 in accompaniment with the rotational driving of the suction fan 29 based on the detection signal from the pressure detection sensor 32. The controller 44 provides error notification in the case that the driving states of the first drive roller 25*a*, the second drive roller 33*a*, and the suction fan 29 (rotation amount, tension, suction force) are not in alignment with the driving conditions stipulated based on control signals transmitted from the first conveying motor driver 50, the second conveying motor driver 52, and the suction fan motor driver 54, which provide driving, respectively. In other words, the controller 44 progressively monitors whether the first drive roller 25*a*, the second drive roller 33*a*, and the suction fan 29 are operating in a normal fashion based on the control signals transmitted from the first conveying motor driver 50, the second conveying motor driver 52, and the suction fan motor driver 54. High operational reliability can thereby be obtained in the conveyance operation described above.

When the continuous paper 12 is being conveyed, the rotational speed of the second drive roller 33*a* is set to greater than the rotational speed of the first drive roller 25*a*. Tension from the second drive roller 33*a* is thereby made to operate on the continuous paper 12 during conveyance, and the flatness of the continuous paper 12 on the platen 28 can be improved. The continuous paper 12 pulled by the second drive roller 33*a* from the platen 28 to the downstream side in the conveyance direction is sequentially wound by the winding drive shaft 43 on the side further downstream from the second drive roller 33*a* in the conveyance direction. For this reason, the continuous paper 12 substantially does not flex on the side further downstream from the second drive roller 33*a* in the conveyance direction, and is stably conveyed at the speed from the first drive roller 25*a*.

During conveyance, the suction force of the suction fan 29 is set to a level that does not firmly chuck the continuous paper 12 to the support surface PL of the platen 28. It is thereby possible to prevent obstruction of conveyance of the continuous paper 12 with the aid of the suction force of the platen 28, and it is possible to avoid an excessive drive load of the first conveying motor 26 and the second conveying motor 34 during conveyance. The magnitude of the tension can be adjusted with high precision because the tension of the second drive roller 33*a* can be made to reliably operate on the continuous paper 12 without obstruction from the suction force of the platen 28.

In the printer 11 of the present embodiment, the suction force F1 of the suction fan 29 and the governing torque value T1 of the second conveying motor 34 can be modified as desired based on data inputted from the external input device 48 to the controller 44. The drive load of the second conveying motor 34 can thereby be reduced, overheating of the second conveying motor 34 can be prevented, and energy-saving in the device overall can be assured by setting the governing torque value T1 of the second conveying motor 34 to a lower level within a range that can suppress flapping of the continuous paper 12 during conveyance.

Next, in step S16, the controller 44 changes the suction force of the suction fan 29 to F2 by setting the rotational speed of the suction fan motor 30. The suction force F2 is a value greater than the suction force F1 of the suction fan 29 set in step S13. Conveyance of the continuous paper 12 is stopped at this time, and the portion of the continuous paper 12 arranged on the platen 28 is chucked to the support surface PL of the platen 28 with a first chucking force which is substantially equal to the suction force F2.

In other words, the printer 11 of the present embodiment chucks the continuous paper 12 to the support surface PL of the platen 28 with the aid of a first chucking force that is relatively greater during execution of the printing process, and chucks the continuous paper 12 to the support surface PL of the platen 28 with the aid of a second chucking force (suction force F1) that is less than the first chucking force during execution of the conveyance process.

Next, in step S17, the controller 44 sets the governing torque value of the second conveying motor 34 to T2 to thereby change the magnitude of tension that operates from the second drive roller 33*a* on the continuous paper 12. The governing torque value T2 is a value that is less than the governing torque value T1 of the second conveying motor 34 set in step S13. The drive load of the second conveying motor 34 for rotatably driving the second drive roller 33*a* is therefore reduced and energy-saving of the device overall is thereby ensured.

As described above, the controller 44 increases the suction force (suction force F2) of the suction fan 29 in step S16 to chuck the continuous paper 12 to the platen 28, and thereafter reduces the governing torque value of the second conveying motor 34 to T2 in step S17. Since the continuous paper 12 is chucked to the platen 28 in a state of relatively high tension, the continuous paper 12 can be chucked while a high level of flatness is maintained. Positional displacement of the continuous paper 12 does not occur because the tension is low in the state in which the continuous paper 12 is firmly chucked to the platen 28.

Next, in step S18, the controller 44 carries out the printing process on the continuous paper 12. Specifically, the controller 44 reads the print data in relation to the continuous paper 12 from the RAM 47 and transmits the print state thus read to the head driver 49. The head driver 49 starts the printing operation on the continuous paper 12 by causing ink to be jetted from the ink discharge nozzles of the recording heads 36 to the continuous paper 12 supported on the support surface PL of the platen 28.

Figure 11:
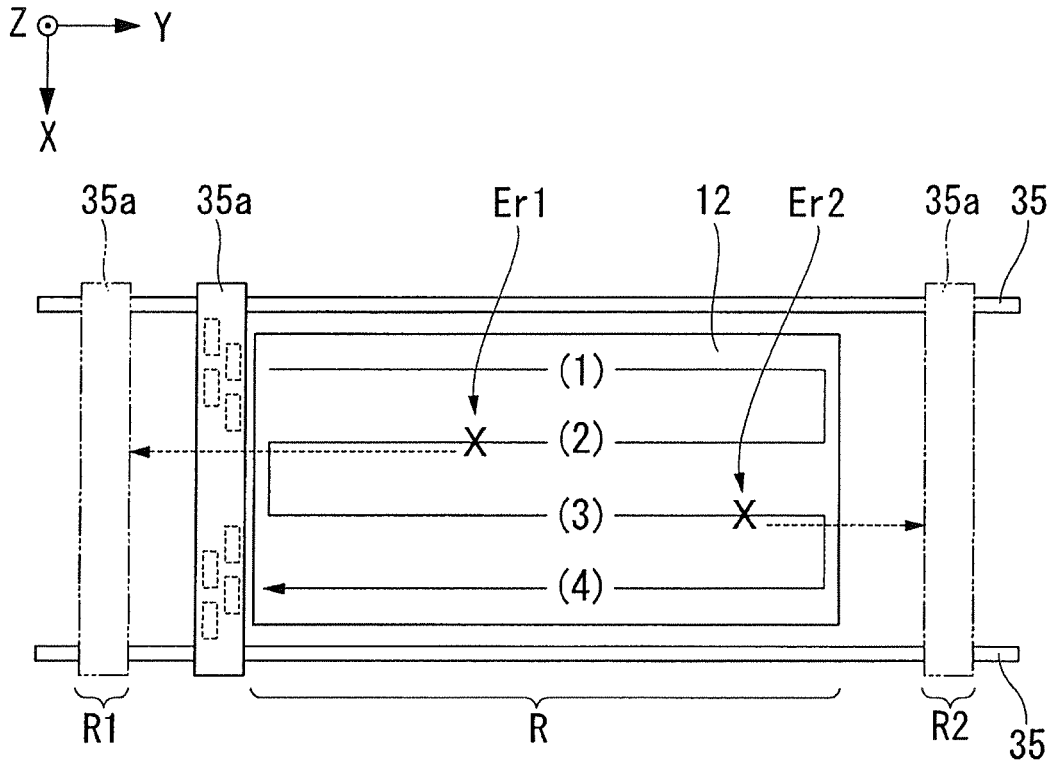
FIG. 11 is a schematic view of the printing operation carried out by the printer.

Here, FIG. 11 is a schematic view of the printing operation carried out by the printer 11. FIG. 11 shows a plan view of a portion of the continuous paper 12 arranged in the print region R, the carriage 35*a*, two guide shafts 35, the first maintenance region R1, and the second maintenance region R2.

In the printer 11 of the present embodiment, the operation for jetting ink from the recording heads 36 while the carriage 35*a* is made to scan in the medium conveyance direction (Y direction; the direction in which the guide shaft extends) to form an image on the continuous paper 12 is repeated four cycles while the recording heads 36 are moved to a new line, as shown in FIG. 11, whereby printing is carried out on the entire surface of the continuous paper 12 in the print region R.

More specifically, in the scan (1) and scan (3) of FIG. 11, ink is jetted from the recording heads 36 while the carriage 35*a* is made to scan from the end part of the upstream side (−Y side) of the medium conveyance direction toward the downstream side (+Y direction), and in the scan (2) and scan (4), and ink is jetted while the carriage 35*a* is made to scan from the downstream side of the medium conveyance direction toward the upstream side in the −Y direction in the drawing. The recording heads 36 are moved to a new line between each of the scans (1) to (4). The plurality of recording heads 36 is mounted on the carriage 35*a* via the head mounting plate 36*a*, and the head mounting plate 36*a* is moved in the width direction (X direction) of the medium, whereby the scan region of the recording heads 36 on the continuous paper 12 is changed.

The second drive roller 33*a* is controlled for torque using the governing torque value T2 during the printing operation, and a continuous tension from the second drive roller 33*a* acts on the continuous paper 12. The first drive roller 25*a* supports the continuous paper 12 in a stopped state as pulled by the second drive roller 33*a* to the downstream side (+Y side) of the medium conveyance direction. For this reason, the continuous paper 12 is kept flat by tension applied by the first drive roller 25*a* and the second drive roller 33*a*. The printing process can thereby be carried out on the continuous paper 12 held in a flat state and high quality printing can be performed.

In the case that the printing operation of step S18 has been completed, the process proceeds to step S19 where the controller 44 determines whether the printing process on the continuous paper 12 will be continued. The process proceeds to step S11 and recursively carries out the processes of steps S11 to S18 in the case that the printing process on the continuous paper 12 will be continued. On the other hand, the program of the processing routine related to the conveyance and printing processes on the continuous paper 12 is ended in the case that printing process on the continuous paper 12 is to be ended.

Next, processing for the case in which an error has occurred in the conveyance system in the printer 11 will be described.

Figure 12:
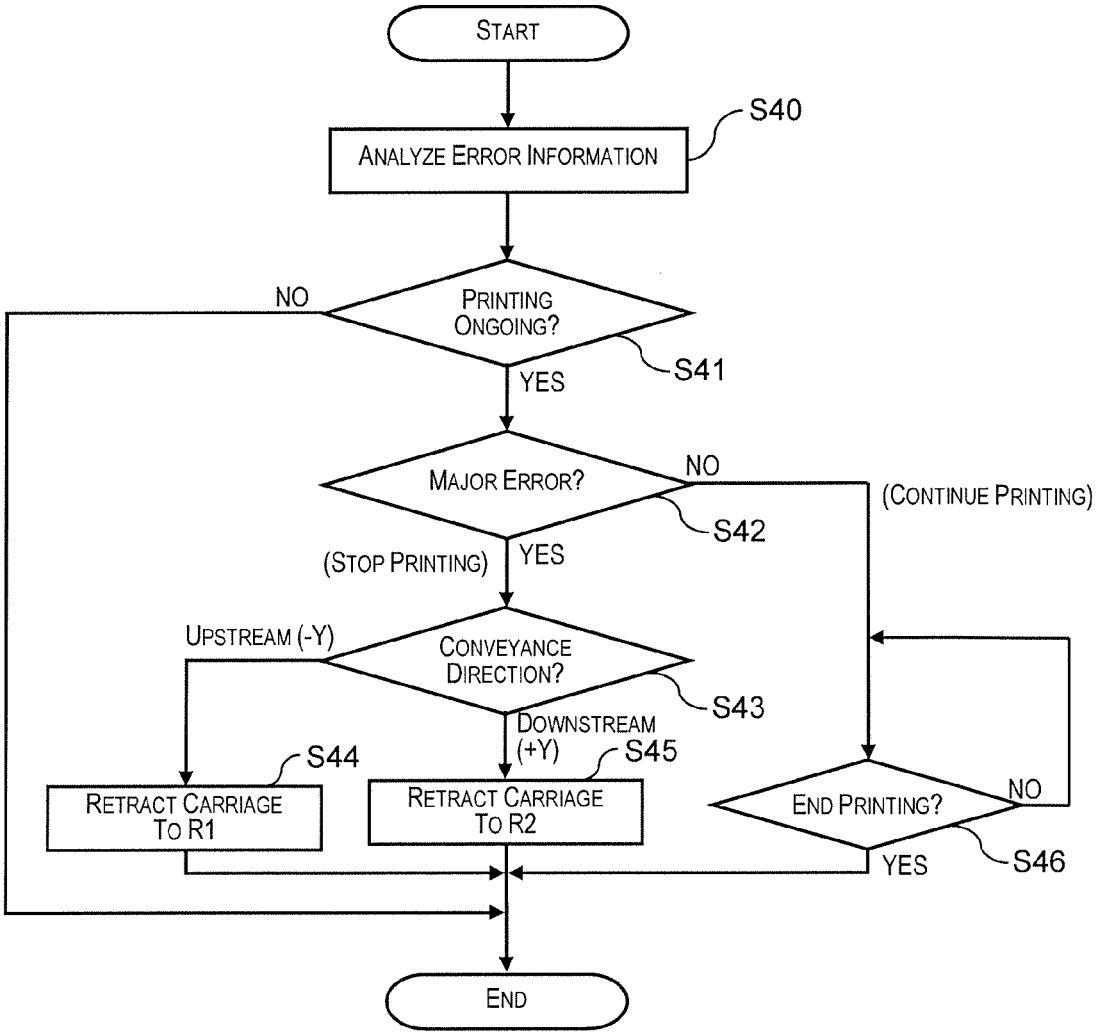
FIG. 12 is a flowchart of the error processing routine.

FIG. 12 is a flowchart of the error processing routine. As described above, in the printer 11 of the present embodiment, errors in the first conveying motor 26 and the second conveying motor 34 are progressively monitored by the error monitoring routine started in step S10 while the steps S11 to S19 are carried out.

The error processing routine shown in FIG. 12 is carried out in the case that the controller 44 is notified of an error that has occurred by the first conveying motor driver 50 and the second conveying motor driver 52 in step S25 of the error monitoring routine shown in FIG. 6.

When the error processing routine is carried out, first, the controller 44 analyzes in step S40 the error information notified by the first conveying motor driver 50 and the second conveying motor driver 52. Specifically, the location (first conveying motor 26, second conveying motor 34) where the error occurred and the type (motor power source abnormality, excessive load on the motor) of error that occurred are specified.

Next, in step S41, the controller 44 acquires the operating state of the printer 11 and judges whether the device is carrying out a printing process. The process proceeds to step S43 in the case that there is an ongoing printing process. On the other hand, in the case that a printing process is not being carried out, and an operation for conveying the continuous paper 12 is ongoing or the device is in a waiting state, the error processing routine is ended and the processing routine related to ongoing conveyance and printing processes is also ended. Therefore, the conveyance operation is stopped even if the continuous paper 12 is currently being conveyed.

Next, in step S42, the controller 44 judges whether the error that has occurred is a major error. The process proceeds to step S43 in the case that the error that has occurred is a major error (in the case of a first-type abnormality), and the operation to safely stop printing is started. On the other hand, in the case that the error is not major (in the case of a second-type abnormality), the process proceeds to step S46 and the printing operation is continued.

In the case of the present embodiment, the major error described above is an error related to an abnormality of the motor power source, and is otherwise an error related to an excessive load on the motor. In other words, in the error monitoring routing shown in FIG. 6, the error about which notification is provided is the major error described above in the case that an error has been judged in step S22, and the error about which notification is provided is a different error in the case that an error has been judged in step S24.

In the case that the error that has occurred is an error related to an abnormality of the motor power source, the first conveying motor 26 and the second conveying motor 34 are in an inoperable state or a state of abnormal operation. In this state, suitable tension is applied to the continuous paper 12 to keep the continuous paper 12 in a predetermined position on the platen 28, and operation is immediately stopped even if a printing operation is ongoing because normal operation is not guaranteed.

On the other hand, it is common to set the reference cumulative value $A_E$ used in error judgments to have a margin so that error notification is possible within a range of normal operation in the case that the generated error is related to an excessive load on the motor. Therefore, an operation abnormality is not immediately flagged at the time point an error is judged. Also, the time required for the printing operation is several second to about several tens of seconds. Accordingly, in the present embodiment, ongoing printing is completed in the case that the error that has occurred is an error related to an excessive load on the motor.

The case in which the error that has occurred has been judged to be a major error (S42: Yes) in step S42 will be described in detail first.

In this case, in step S43, the controller 44 judges the movement direction of the carriage 35*a* in the ongoing printing operation. The process proceeds to step S44 in the case that the carriage 35*a* is traveling to the upstream side (−Y side) of the medium conveyance direction, and the process proceeds to step S45 in the case that the carriage 35*a* is traveling to the downstream side (+Y side) of the medium conveyance direction.

In step S43, the controller 44 may judge the position in the traveling direction of the carriage 35*a* in the ongoing printing operation and carry out the following control regardless of the movement direction of the recording processing part at the time point at which an abnormality has occurred.

In other words, the process proceeds to step S44 in the case that the edge on the side shorter in distance from the carriage 35*a* at the time the abnormality occurred is the upstream side (−Y side) of the medium conveyance direction, the edge being one among the two ends in the traveling direction of the support surface PL of the platen 28, and proceeds to step S45 in the case that the edge is the downstream side (+Y side) of the medium conveyance direction.

The carriage 35*a* is retracted to the first maintenance region R1 shown in FIG. 2 in the case that the process has proceeded to step S44. On the other hand, the carriage 35*a* is retracted to the second maintenance region R2 shown in FIG. 2 in the case that process has proceeded to step S45. This operation is described in greater detail below with reference to FIG. 11.

Since the carriage 35*a* is moving toward the upstream side (−Y side) of the medium conveyance direction in the case that a major error has occurred when the carriage 35*a* is positioned in a first position Er1 of the scan (2) shown in FIG. 11, the step S44 described above is selected and an operation for retracting the carriage 35*a* to the first maintenance region R1 is started. At this time, the carriage 35*a* is merely moved to the outside of the print region R without a change in direction, whereby the carriage 35*a* can be retracted to the first maintenance region R1 because the first maintenance region R1 is positioned along the movement direction of the carriage 35*a*.

Since the carriage 35*a* is moving toward the downstream side (+Y side) of the medium conveyance direction in the case that a major error has occurred when the carriage 35*a* is positioned in a second position Er2 of the scan (3), the step S45 described above is selected and an operation for retracting the carriage 35*a* to the second maintenance region R2 is started. In this case as well, the carriage 35*a* is merely moved directly to the outside of the print region R without the need for a change in direction, whereby the carriage 35*a* can be retracted to the second maintenance region R2.

On the other hand, in step S42, the printing process is continued until completion while the end of the printing process is judged in step S46 in the case that the error that has occurred is judged to be a major error (S42: No). After the printing operation has been completed, the error processing routine is ended and the processing routine related to the ongoing conveyance and printing processes are also ended. Therefore, only the ongoing printing operation is carried out when the error occurs and the conveyance and/or printing operation of the continuous paper 12 is then stopped even when during consecutive printing in which conveyance and printing of the continuous paper 12 are repeatedly carried out.

As described above in detail, in accordance with the printer of the present embodiment, the electric current value that flows to the first conveying motor 26 and the second conveying motor 34 is confirmed in the first conveying motor driver 50 and the second conveying motor driver 52, whereby a power source abnormality of the first conveying motor 26 and the second conveying motor 34 can be detected and the controller 44 can be notified. An abnormality in the conveyance system can thereby be rapidly detected. Since it is therefore possible to rapidly respond to an abnormality in the conveyance system, the continuous paper 12 can be prevented from flexing or the like, thus considerably contributing to stable operation of the device.

In the first conveying motor driver 50 and the second conveying motor driver 52, an excessive load due to heating of the first conveying motor 26 and the second conveying motor 34 is detected with the aid of computational processing that is based on the electric current value that flows to the first conveying motor 26 and the second conveying motor 34, and the controller 44 can be notified. An abnormality in the conveyance system can thereby be rapidly detected. Since it is therefore possible to rapidly respond to an abnormality in the conveyance system, the continuous paper 12 can be prevented from flexing or the like, thus considerably contributing to stable operation of the device.

The configuration for detecting an error related to the excessive load described above may be a configuration for computing load information $a=i^2\alpha-\beta$, wherein i is a control-target motor electric current value, $\alpha$ is an electric current calorimetric coefficient, and $\beta$ is a heat discharge constant; computing a cumulative value A of load information a; and detecting an excessive load of the first conveying motor 26 and the second conveying motor 34 when the cumulative value A of the load information a is greater than a reference cumulative value $A_E$ set in advance. It is thereby possible to detect an excessive load of a conveying motor with relatively high precision by using simple computational processing. Also, initial setting can be carried out in a simple fashion because the electric current calorimetric coefficient $\alpha$ and the heat discharge constant $\beta$ can be readily set by experimentation.

Abnormality of the first encoder 26E and the second encoder 34E can be detected in the first conveying motor driver 50 and the second conveying motor driver 52 and the controller 44 can be notified by confirming the count signals of the first encoder 26E and the second encoder 34E connected to the first conveying motor 26 and the second conveying motor 34. An abnormality in the conveyance system can thereby be rapidly detected. Since it is therefore possible to rapidly respond to an abnormality in the conveyance system, the continuous paper 12 can be prevented from flexing or the like, thus considerably contributing to stable operation of the device.

In the case that the error that has occurred in the conveyance system is a major error, it is possible to prevent the recording heads 36 and the continuous paper 12 from making contact with each other in the case that the continuous paper 12 has flexed due to an abnormal operation in the first conveying motor 26 or the second conveying motor 34, because the printing operation is rapidly stopped and the carriage 35*a* is retracted outside the print region R even when the printer 11 is carrying a printing operation.

In the case that printing is interrupted and the carriage 35*a* is retracted as described above, the carriage 35*a* can be rapidly retracted from the print region R because the carriage 35*a* is retracted to a maintenance region positioned along the movement direction of the carriage 35*a* of when an error has occurred. Also, it is possible that the conveyance system of the carriage 35*a* will be damaged if the carriage 35*a* undergoes a rapid change in direction, but it is possible to avoid the occurrence of such damage in the embodiment described above.

In the case that the error that has occurred in the conveyance system is not a major error, an ongoing printing operation is completed if the printer 11 is carrying out a printing process. Waste of in-process product due to a minor error can thereby be prevented.

In the embodiment described above, the second conveying motor 34 drives the second drive roller 33*a* under torque control, whereby the magnitude of the tension applied by the second drive roller 33*a* to the continuous paper 12 is adjusted. Accordingly, the continuous paper 12 conveyed while supported by the platen 28 can be reliably pulled along the conveyance route.

The second drive roller 33*a* applies tension so that the continuous paper 12 supported by the platen 28 is pulled toward the downstream side of the conveyance direction. On the other hand, the first drive roller 25*a* does not pull the continuous paper 12 and the continuous paper 12 is therefore not conveyed in the opposite direction toward the upstream side of the conveyance direction. The continuous paper 12 can thereby be conveyed with high precision because positioning errors of the continuous paper 12 do not occur due to conveyance in the opposite direction.

Tension is applied by the second drive roller 33*a* to the continuous paper 12 during conveyance of the continuous paper 12 and during conveyance stoppage. The continuous paper 12 can be conveyed in a stable state because flapping of the continuous paper 12 is suppressed during conveyance of the continuous paper 12. Also, the continuous paper 12 supported by the platen 28 can be reliably pulled along the conveyance route when the conveyance of the continuous paper 12 has been stopped.

The embodiment described above may be modified in the following manner.

Chucking means for chucking the continuous paper 12 to the support surface PL of the platen 28 may be an electrostatic chucking device for electrostatically chucking the continuous paper 12 to the support surface PL of the continuous paper 12. In this case, the electrostatic chucking device preferably has a configuration in which the continuous paper 12 is electrostatically chucked to the support surface PL of the platen 28 with a first electrostatic chucking force during the printing process of the continuous paper 12, and the continuous paper 12 is electrostatically chucked to the support surface PL of the platen 28 with a second electrostatic chucking force that is less than the first electrostatic chucking force during the conveyance process of the continuous paper 12.

Another possible configuration is one in which a list of data of the governing torque values T1, T2 of the second conveying motor 34 corresponding to individual materials of the continuous paper 12 is stored in advance in the ROM 46. In this case, the controller 44 reads the governing torque values T1, T2 of the second conveying motor 34 from the ROM 46 during the conveyance and printing processes of the continuous paper 12 in accordance with the material of the continuous paper 12 to be processed, and controls the torque of the second drive roller 33*a* using the governing torque values T1, T2 of the second conveying motor 34 thus read.

The magnitude relationship between the governing torque values T1, T2 is not limited to the embodiments described above. For example, the governing torque value T2 of the second conveying motor 34 may be set to be greater during the printing process than the governing torque value T1 of the second conveying motor 34 during the conveyance process in the case that the swelling ratio of the continuous paper 12 is extremely great when the ink is absorbed.

An atmosphere release value for opening the interior of the negative pressure chamber 31 to atmosphere may be provided to the platen 28. Conveyance of the continuous paper 12 can be started with earlier timing when the level of reduced pressure inside the negative pressure chamber 31 is rapidly reduced when suction force adjustment by the suction fan 29 and an atmosphere release value are used in combination.

A flow rate detection sensor for detecting the flow rate of air exhausted via the suction fan 29 may be provided in lieu of the pressure detection sensor 32 of the embodiments described above. Since the exhaust flow rate decreases in accompaniment with a reduction in pressure when the interior of the negative pressure chamber 31 is evacuated by the suction fan 29, the pressure inside the negative pressure chamber 31 can be estimated based on the exhaust flow rate detected by the flow rate detection sensor.

A long plastic film or the like may be used as the recording medium.

In the embodiments described above, an inkjet printer was used as a specific example of a recording device, but no limitation is imposed thereby; it is also possible to use a fluid-jetting device that jets or discharges a fluid (including a liquid or gel-like liquid in which functional material particles are dispersed or mixed in the fluid) other than ink.

Other examples include a fluid-jetting device for jetting a fluid (liquid) that includes electrode material, color material (pixel material), or other material in the form of a dispersion or solution used in the manufacture or the like of liquid crystal displays, electroluminescence (EL) displays, and surface-emission displays; a fluid-jetting device for jetting bioorganic substances in the manufacture of biochips; and a fluid-jetting device for jetting a fluid that is a test material used as precision pipettes. Further examples include fluid-jetting devices for jetting a lubricant with pinpoint accuracy in watches, cameras, and other precision equipment; fluid-jetting devices for jetting a UV-curable resin or another transparent resin fluid onto a substrate in order to form a very small semispherical lens (optical lens) used in optical communication elements or the like; fluid-jetting devices for jetting acidic or alkali etching fluid for etching a substrate or the like; and a fluid-jetting device for jetting gel (e.g., physical gel) or another fluid (liquid). It is possible to apply the present invention to any type of these fluid-jetting devices.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A recording device comprising:

a medium-supporting part configured and arranged to support a long recording medium;

a recording processing part configured and arranged to perform recording process for recording on the recording medium supported on the medium-supporting part;

a recording processing part conveyance system configured and arranged to move the recording processing part parallel to a support surface of the medium-supporting part along a moving direction;

a medium conveyance system including a first drive roller configured and arranged to feed the recording medium to the medium-supporting part, a first drive motor connected to the first drive roller, a second drive roller configured and arranged to convey the recording medium out from the medium-supporting part, and a second drive motor connected to the second drive roller; and a control unit configured to control the recording device in response to an occurrence of a predetermined abnormality in the medium conveyance system in an interval in which the recording processing is carried out on the recording medium while the recording processing part scans above the recording medium by the recording processing part conveyance system, the control unit is configured to carry out an operation to, in response to the occurrence of the abnormality while the recording processing part is moving in a first direction along the moving direction and performing the recording process, retract the recording processing part to an area outside of the medium-supporting part by moving the recording processing part in the first direction of the recording processing part, or carry out an operation to, in response to the occurrence of the abnormality while the recording processing part is moving in the first direction and performing the recording process, retract the recording processing part to an area outside of the medium-supporting part by moving recording processing part in one of the first direction and a second direction along the moving direction, which is closer to one of edges of the medium-supporting part from a position of the recording processing part at a time at which the abnormality has occurred, regardless of the first direction of the recording processing part.

2. A recording device comprising:

a medium-supporting part configured and arranged to support a long recording medium;

a recording processing part configured and arranged to perform recording process for recording on the recording medium supported on the medium-supporting part;

a recording processing part conveyance system configured and arranged to move the recording processing part parallel to a support surface of the medium-supporting part;

a medium conveyance system including a first drive roller configured and arranged to feed the recording medium to the medium-supporting part, a first drive motor connected to the first drive roller, a second drive roller configured and arranged to convey the recording medium out from the medium-supporting part, and a second drive motor connected to the second drive roller; and a control unit configured to control the recording device such that, when a predetermined abnormality has occurred in the medium conveyance system in an interval in which the recording processing is carried out on the recording medium while the recording processing part scans above the recording medium by the recording processing part conveyance system, the control unit is configured to carry out an operation to retract the recording processing part to an area outside of the medium-supporting part while maintaining a movement direction of the recording processing part at a time at which the abnormality has occurred, or carry out an operation to retract the recording processing part to an area outside of the medium-supporting part so as to move in a direction toward a closer one of edges of the medium-supporting part at a time at which the abnormality has occurred, regardless of the movement direction of the recording processing part at the time at which the abnormality has occurred, the control unit being configured to carry out the operation to retract the recording processing part when the abnormality occurring in the medium conveyance system is a first type, and to continue the recording process when the abnormality is a second type that is different from the first type.

3. The recording device according to claim 2, wherein the medium conveyance system includes a motor control unit configured to control operations of at least one of the first drive motor and the second drive motor, the motor control unit is configured to detect the first type of abnormality based on a comparison of a reference electric current value set in advance and an electric current value of the at least one of the first drive motor and the second drive motor after a predetermined time has elapsed from a time at which a control signal for controlling the at least one of the first drive motor and the second drive motor to rotate is outputted, and compute and cumulate load information of the at least one of the first drive motor and the second drive motor based on the electric current value of the at least one of the first drive motor and the second drive motor being controlled, and detect the second type of abnormality based on a comparison of a resulting cumulative value and a reference cumulative value.

4. The recording device according to claim 3, wherein the reference electric current value used by the motor control unit is a lower one of a target electric current value of the at least one of the first drive motor and the second drive motor after the predetermined time has elapsed and a maximum electric current value set in accordance with a rotational speed of the at least one of the first drive motor and the second drive motor.

5. The recording device according to claim 3, wherein the motor control unit is configured to compute the load information $a=i^2\alpha-\beta$, wherein i is an electric current value of the at least one of the first drive motor and the second drive motor, $\alpha$ is an electric current calorimetric coefficient, and $\beta$ is a heat discharge constant, compute a cumulative value A of the load information a, and detect an excessive load of the at least one of the first drive motor and the second drive motor when the cumulative value A of the load information a is greater than a reference cumulative value $A_E$ set in advance.

* * * * *